US012324483B2

(12) United States Patent
Giacopelli

(10) Patent No.: US 12,324,483 B2
(45) Date of Patent: Jun. 10, 2025

(54) APPARATUS TO PREVENT CONTACT BETWEEN SPUR OR RIDING BOOT AND A HORSE

(71) Applicant: Jennifer Giacopelli, Brewster, NY (US)

(72) Inventor: Jennifer Giacopelli, Brewster, NY (US)

( * ) Notice: Subject to any disclaimer, the term of this patent is extended or adjusted under 35 U.S.C. 154(b) by 0 days.

(21) Appl. No.: 18/063,945

(22) Filed: Dec. 9, 2022

(65) Prior Publication Data

US 2023/0180881 A1 Jun. 15, 2023

Related U.S. Application Data

(60) Provisional application No. 63/287,666, filed on Dec. 9, 2021.

(51) Int. Cl.

| | |
|---|---|
| ***A43B 13/20*** | (2006.01) |
| ***A43B 5/00*** | (2022.01) |
| ***A43B 5/18*** | (2006.01) |

(52) U.S. Cl.

CPC ..... *A43B 5/006* (2013.01); *A43B 5/18* (2013.01); *A43B 13/20* (2013.01)

(58) Field of Classification Search

CPC ..... A43B 13/20; A43B 5/18; A43B 23/20
USPC ..... 36/72 B, 7.2, 7.4, 7.7
See application file for complete search history.

(56) References Cited

U.S. PATENT DOCUMENTS

| | | | | |
|---|---|---|---|---|
| 147,701 A | | 2/1874 | Speed | |
| 1,180,633 A | | 4/1916 | Brackin | |
| 2,894,339 A | * | 7/1959 | Shapiro | A43B 23/30 36/72 B |
| 4,498,252 A | * | 2/1985 | Connors | A43C 13/02 36/72 B |
| 4,662,082 A | * | 5/1987 | Shabazz | A43B 23/30 36/72 B |

(Continued)

FOREIGN PATENT DOCUMENTS

| | | |
|---|---|---|
| CA | 2541586 A1 | 9/2007 |
| CN | 103494373 A | 1/2014 |

(Continued)

OTHER PUBLICATIONS

English Translation of FR 2530430 (Year: 1984).*

(Continued)

*Primary Examiner* — Ted Kavanaugh
(74) *Attorney, Agent, or Firm* — Ware, Fressola, Maguire & Barber LLP

(57) ABSTRACT

An apparatus, a system, and a method for protecting a horse from a riding boot or spur is provided. The apparatus comprises a body section having a rear portion which is padded and configured to cover a lower rear part of a footwear item, and the body section is configured to wrap around an ankle section of the footwear item. The apparatus further includes an adjustable closure mechanism configured to close the apparatus and secure the apparatus around the ankle section of the footwear item; and an open top portion, an open bottom portion, and an open front portion, each of which is configured to receive a part of the footwear item therethrough. The apparatus may be worn over a riding boot having a spur, and the apparatus protects the horse from contact by the spur.

13 Claims, 13 Drawing Sheets

(56) References Cited

U.S. PATENT DOCUMENTS

| | | | | | |
|---|---|---|---|---|---|
| 4,825,563 | A * | 5/1989 | Strongwater | A43B 3/16 36/73 |
| 5,257,469 | A * | 11/1993 | Beasley | A43B 5/007 36/72 B |
| 5,613,250 | A | 3/1997 | Bell | |
| 5,771,607 | A * | 6/1998 | Dean | A43B 23/30 36/72 B |
| 5,775,007 | A * | 7/1998 | Expose | A43B 5/007 36/72 B |
| 7,464,487 | B2 | 12/2008 | Boyd | |
| 7,523,567 | B1 | 4/2009 | McClelland | |
| 7,814,685 | B1 * | 10/2010 | Tankson | A43B 5/007 36/72 B |
| 7,836,524 | B2 | 11/2010 | Muench | |
| 8,448,356 | B2 | 5/2013 | Edwards et al. | |
| 2004/0088887 | A1 | 5/2004 | Kim | |
| 2004/0159084 | A1 | 8/2004 | Franklin et al. | |
| 2005/0183285 | A1 | 8/2005 | Cote | |
| 2008/0016828 | A1 | 1/2008 | Strauss | |
| 2015/0307343 | A1 | 10/2015 | Daly | |
| 2016/0081422 | A1 | 3/2016 | Garneau | |
| 2016/0113240 | A1 | 4/2016 | Cherubini et al. | |
| 2016/0316851 | A1 | 11/2016 | Markin | |
| 2021/0059358 | A1 | 3/2021 | Schulten-Gaywood | |

FOREIGN PATENT DOCUMENTS

| | | | |
|---|---|---|---|
| CN | 102892322 | B | 4/2016 |
| CN | 212971892 | U | 4/2021 |
| DE | 20314490 | U1 | 3/2004 |
| DE | 102022111044 | A1 | 12/2022 |
| EP | 3895574 | A1 | 10/2021 |
| FR | 2497076 | A1 | 7/1982 |
| FR | 2530430 | A1 * | 1/1984 |
| GB | 351241 | A | 6/1931 |
| GB | 2310359 | A | 8/1997 |
| GB | 2541409 | A | 2/2017 |
| WO | 2009041838 | A1 | 4/2009 |

OTHER PUBLICATIONS

"Ridertack Boot Accessories" Equiwin, Boot Cover Sethttps://www.ridertack.com/toe-boot-p/ewbtcvfl.htm, Nov. 2021 (2 pages).

"Tweedland" the gentlemans club http://tweedlandthegentlemansclub.blogspot.com/ 2017/02/ spats-videohow-to-strap-white-spats.html, Feb. 14, 2017 (7 pages).

International Search Report and Written Opinion, Application No. PCT/US2022/081257, mailed Mar. 31, 2023 (9 pages).

* cited by examiner

APPARATUS TO PREVENT CONTACT BETWEEN SPUR OR RIDING BOOT AND A HORSE

CROSS-REFERENCE TO RELATED APPLICATIONS

The present application claims the benefit of U.S. Provisional Patent Application 63/287,666 filed Dec. 9, 2021, which is hereby incorporated by reference in its entirety.

BACKGROUND OF THE INVENTION

In horse riding, if the rider wears a spur on the heel of his or her riding boot, there is a risk that the spur can graze or scrape against the horse, creating pain and discomfort for the horse. Even without spurs, it is possible that the heel of the riding boot can similarly contact the horse causing similar discomfort.

There are currently some solutions provided in the field to prevent the contacting of a spur against the horse. One is a so-called belly wrap, which is a band wrapped around the horse's back and stomach which covers the horse with a layer, and saddle pads are also provided, which provide pads extending down from a saddle and cover the part of the horse prone to discomfort from a spur. However, these are large objects that the horse must wear during riding. Other options include spur protectors that cover a spur with rubber, but these still expose the horse to the spur and discomfort.

What is needed is a device that addresses these shortcomings, and also provides relief for the horse from contact by the spur or boot while not burdening the horse with additional devices to wear during riding.

SUMMARY OF THE DISCLOSURE

The present application relates to an apparatus to prevent a spur or riding boot from contacting or chafing against a horse that is worn over a riding boot and spur. The apparatus covers an area from the heel to the ankle of the rider. It may be secured by an elastic strap under the bottom of the boot, and a hook and loop attachment or adjustable fastener across the top of the ankle. The apparatus provides a layer of protection between the rider's boot and the side of a horse's barrel/body where the inside of a riding boot makes contact with the horse. It can be worn once a scrape has occurred on the horse to allow for protection and healing, or as a preventative measure for horses prone to discomfort from spurs or boots. The apparatus can be worn with or without spurs, as the apparatus may comprise an elastic material that can stretch to accommodate most spurs. The apparatus can be worn by any rider in any discipline (e.g., English, Western, hunter/jumper, dressage, eventing, and recreational riders). Discomfort to the horse can occur with or without the use of a spur, and the apparatus protects the horse against chafing by a spur or a riding boot.

In accordance with a first aspect of the present application, an apparatus is provided. The apparatus comprises a body section having a rear portion which is padded and configured to cover a lower rear part of a footwear item, and the body section is configured to wrap around an ankle section of the footwear item. The apparatus further comprises an adjustable closure mechanism configured to close the apparatus and secure the apparatus around the ankle section of the footwear item; and an open top portion, an open bottom portion, and an open front portion, each of which is configured to receive a part of the footwear item therethrough.

Implementations of the apparatus of the first aspect of the present application may include one or more of the following features. The apparatus may comprise a lower strap separating the open bottom portion and the open front portion, and which is configured to rest against a sole of the footwear item. The adjustable closure mechanism may comprise: a strap having a first end fixed to a first part of the body section and having a second end may include a fastening means; and a corresponding fastening means arranged on a second part of the body section separated from the first part of the body section by a gap, and configured to engage the fastening means on the strap. The fastening means and corresponding fastening means may comprise hook and loop fasteners. The body section of the apparatus may include: a central section that is substantially rectangular and having the rear portion of the body section; and two wing sections, one wing section being disposed on each end of the central section, wherein each wing section extends upwardly from the central section and the two wing sections are configured to be brought together in closing the apparatus and substantially cover a front portion of the footwear item. The adjustable closure mechanism may include: a strap having one end fixed to a first of the two wing sections and a second end including a fastening means; and a corresponding fastening means arranged on a second of the two wing sections that is configured to engage the fastening means on the strap. In additional or alternative embodiments, the apparatus may further include: a removable sleeve comprising the padded rear portion that is configured to be connected and disconnected from the body section of the apparatus.

In accordance with a second aspect of the present application, a system is provided. The system comprises a footwear item, and an apparatus arranged over and around an ankle section of the footwear item. The apparatus comprises: a body section having a rear portion which is padded and configured to cover a lower rear part of the footwear item, the body section being configured to wrap around the ankle section of the footwear item; an adjustable closure mechanism configured to close the apparatus and secure the apparatus around the ankle section of the footwear item; and an open top portion, an open bottom portion, and an open front portion, each of which is configured to receive a part of the footwear item therethrough.

The system of the second aspect of the present application may comprise additional features in various embodiments thereof. In accordance with embodiments of the system, the footwear item is a horse riding boot, and the apparatus is configured to cover the lower rear part of the horse riding boot. The lower rear part of the horse riding boot may include a spur arranged thereon, and the apparatus is configured to cover the spur to prevent the spur from contacting a horse during riding. The body section of the apparatus may include a central section that is substantially rectangular and may include the rear portion of the body section; and two wing sections, one wing section being disposed on each end of the central section, where each wing section extends upwardly from the central section and the two wing sections are configured to be brought together in closing the apparatus and substantially cover a front portion of the footwear item. The adjustable closure mechanism may include: a strap having one end fixed to a first of the two wing sections and having a second end may include a fastening means; and a corresponding fastening means arranged on a second of the two wing sections, and configured to engage the fastening means on the strap. The body section may be formed of a material that includes a core material layer; an inner material layer on one side of the core material layer; and an outer material layer on an opposing side of the core material layer.

In accordance with a third aspect of the present application, a method of protecting a horse from a horse riding boot or a spur on a rider is provided. The method comprises arranging an apparatus over and around an ankle section of the horse riding boot of the rider, the apparatus comprising: a body section having a rear portion which is padded and configured to cover a lower rear part of the horse riding boot, the body section being configured to wrap around the ankle section of the horse riding boot; an adjustable closure mechanism configured to close the apparatus and secure the apparatus around the ankle section of the horse riding boot; and an open top portion, an open bottom portion, and an open front portion, each of which is configured to receive a part of the horse riding boot therethrough. The rear portion of the apparatus is configured to protect the horse from the lower rear part of the horse riding boot by preventing contact between the horse and the lower rear part of the horse riding boot. In accordance with various embodiments of the method, the lower rear part of the horse riding boot may include a spur arranged thereon, and the rear portion of the apparatus is configured to protect the horse from the spur by preventing contact between the horse and the spur.

DETAILED DESCRIPTION OF THE FIGURES

Figure 1:
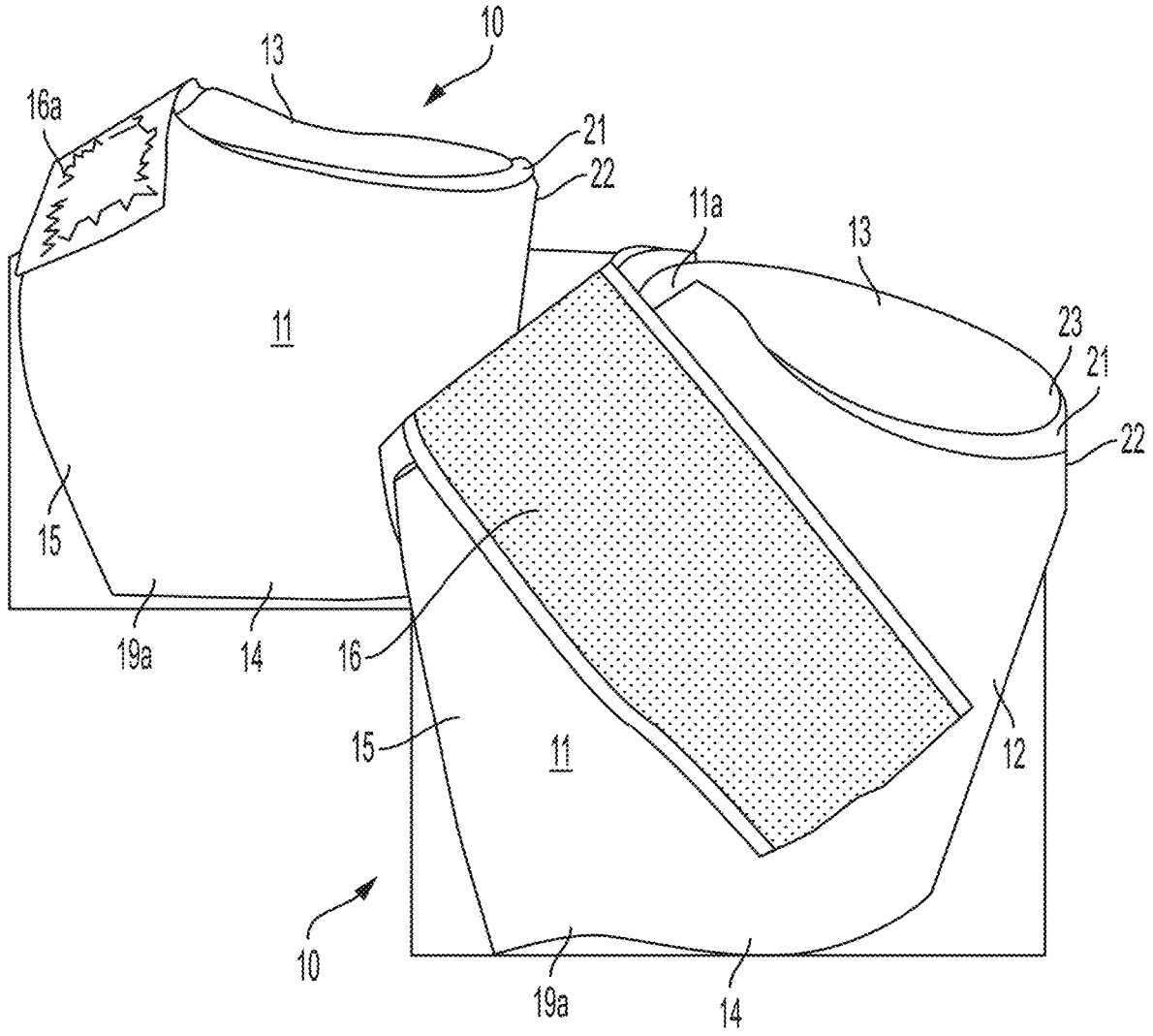
FIG. 1 show first side views of left and right apparatuses according to the present application.

Illustrative embodiments of the apparatus 10 of the present application are shown in FIGS. 1-6F.

The apparatus 10 may have a generally cylindrical shape when closed, formed by a body 11, which is placed over and around the ankle of a riding boot 50. The body 11 includes a rear portion 12 adjacent to the user's Achilles tendon, which covers the lower rear part of the riding boot 50 above the heel on the sole of the riding boot 50. The rear portion 12 of the apparatus 10 also covers any spur that the rider may have attached to the riding boot 50 and arranged on the heel or ankle of the riding boot 50.

The apparatus 10 further includes a top opening 13, a bottom opening 14, and a front opening 15, through which the rider can insert his or her boot 50, such that the front of the boot 50 extends through the front opening 15, the heel on the sole of the boot 50 extends through the bottom opening 14 and the top section of the boot 50 above the ankle extends from the top opening 13. The bottom opening 14 and front opening 15 of the apparatus 10 may be a single, contiguous opening formed by the wrapping of the body section 11 around the boot 50. The bottom opening 14 and the front opening 15 may also be separated by a lower strap 19 that aids in securing the apparatus 10 to the riding boot 50 by resting against the sole of the boot 50.

Between the top opening 13 and front opening 15, an adjustable closure mechanism is provided, which may include a strap 16. In various embodiments of the apparatus 10, the apparatus 10 is closed when two ends of the body 11 are brought together, with a gap 11*a* formed in the body 11 between the two ends of the body 11, and between the top opening 13 and front opening 15, across which the strap 16 is provided, such that the apparatus 10 can be wrapped around the boot 50 rather than needing to be slid over the boot 50. In other embodiments, a portion of the strap 16 can be secured to the body 11 of the apparatus 10, and the apparatus 10 can be slid over the riding boot 50, such as passing the strap 16 through a loop on the body 11 where it can be pulled to tighten or release the apparatus 10 around the boot 50.

In the embodiment shown in the Figures, the strap 16 has an end 16*a* affixed to one end of the body 11, and the strap 16 includes one portion of a hook-and-loop fastener 17 configured to engage a corresponding fastener 18 on another part the body 11 of the apparatus 10. In other embodiments, other connecting means can be provided for use with the strap 16 in place of a hook and loop fastener, and the closure mechanism or strap 16 can be provided with one or more types of connecting means, including for example corresponding ends of a snap fit or button engagement, corresponding engaging magnetic elements, corresponding buckle and locking elements, strings or ropes configured to be tied, corresponding tabs and receiving elements, or any other suitable mechanism for securely connecting the strap 16 to the body 11 of the apparatus 10. With the strap 16, the apparatus 10 can be provided in a single or limited number of sizes that can be adapted for use with boots 50 of different sizes, as the strap 16 allows for the adjustment of the width of the openings 13, 14, 15 of the apparatus 10. An additional lower strap 19 can be provided that is arranged under the sole of the boot 50. Each end 19*a* of the lower strap 19 may be affixed to the body 11 of the apparatus 10. The lower strap 19 is arranged in between the bottom opening 14 and the front opening 15, and can be arranged to rest on the sole against the raised component of the lower heel of the boot 50, if the boot 50 includes a raised heel.

Figure 2A:
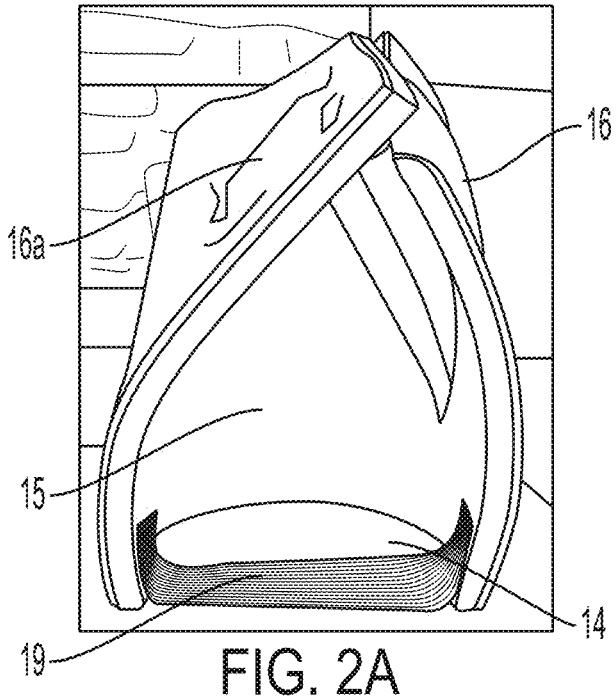
FIG. 2A shows a front view of a left apparatus according to the present application.
Figure 2B:
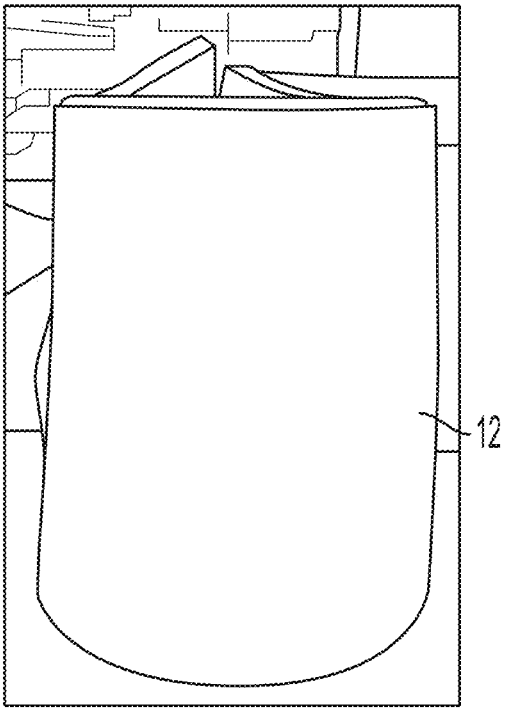
FIG. 2B shows a rear view of a right apparatus according to the present application.
Figure 2C:
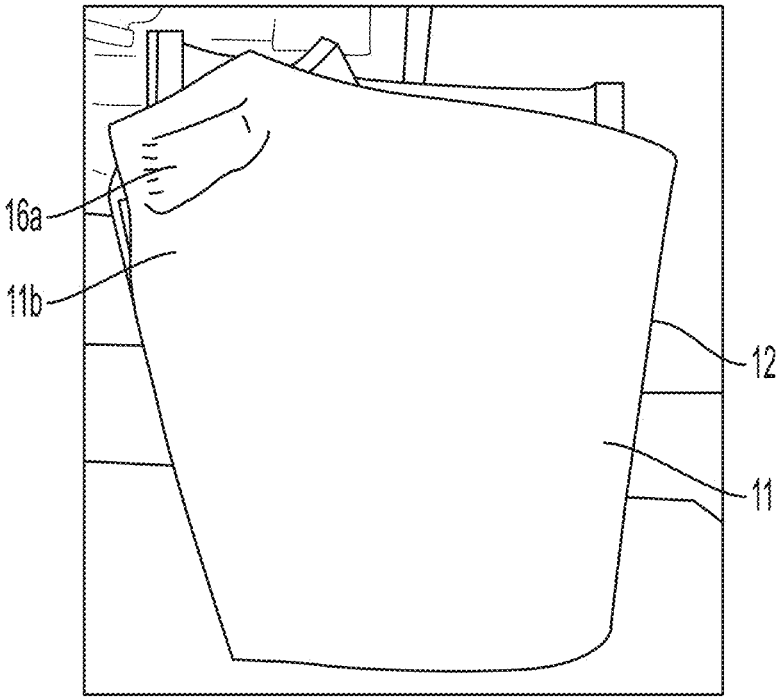
FIG. 2C shows a first side view of the apparatus of FIG. 2B.
Figure 2D:
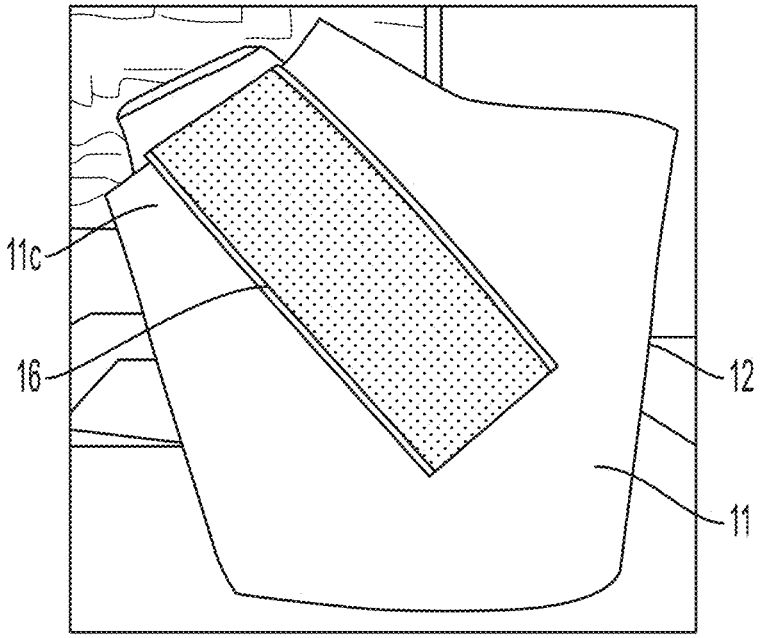
FIG. 2D shows a second side view of the apparatus of FIG. 2A.
Figure 2E:
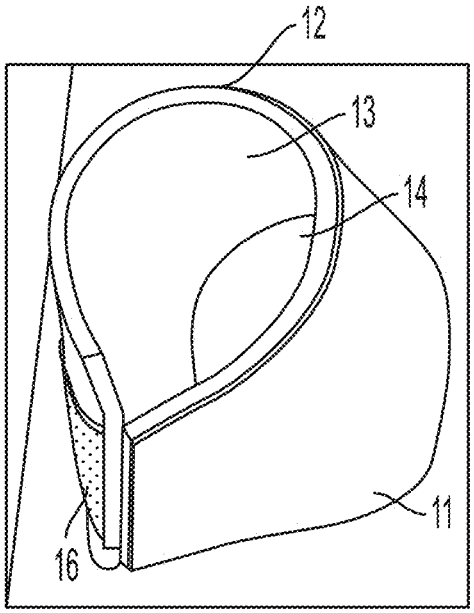
FIG. 2E shows a top view of the apparatus of FIG. 2B.
Figure 2F:
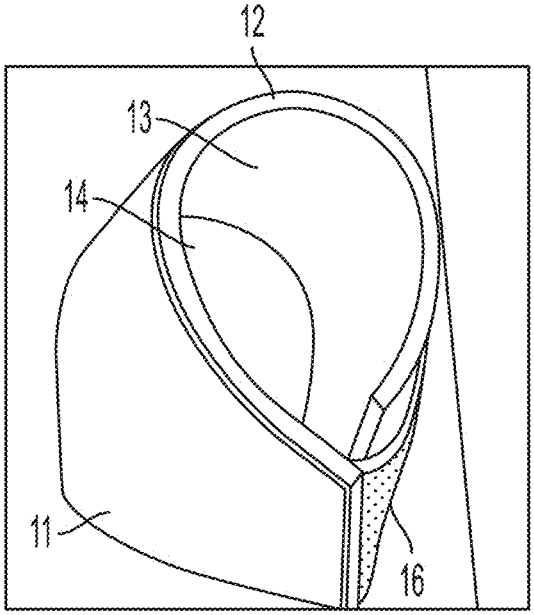
FIG. 2F shows a top view of the apparatus of FIG. 2A.
Figure 2G:
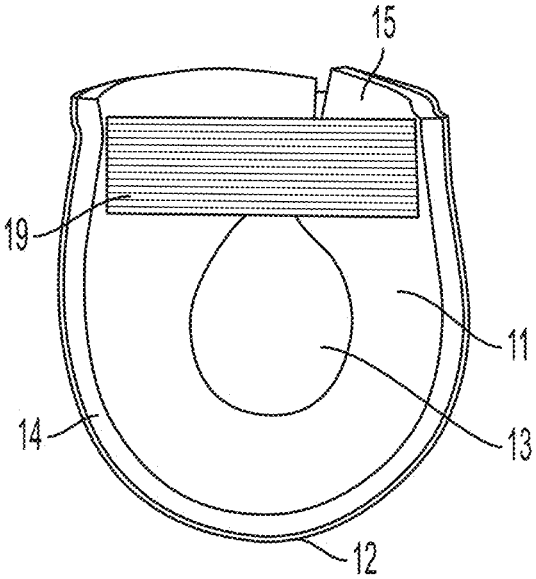
FIG. 2G shows a bottom view of the apparatus of FIG. 2A.
Figure 2H:
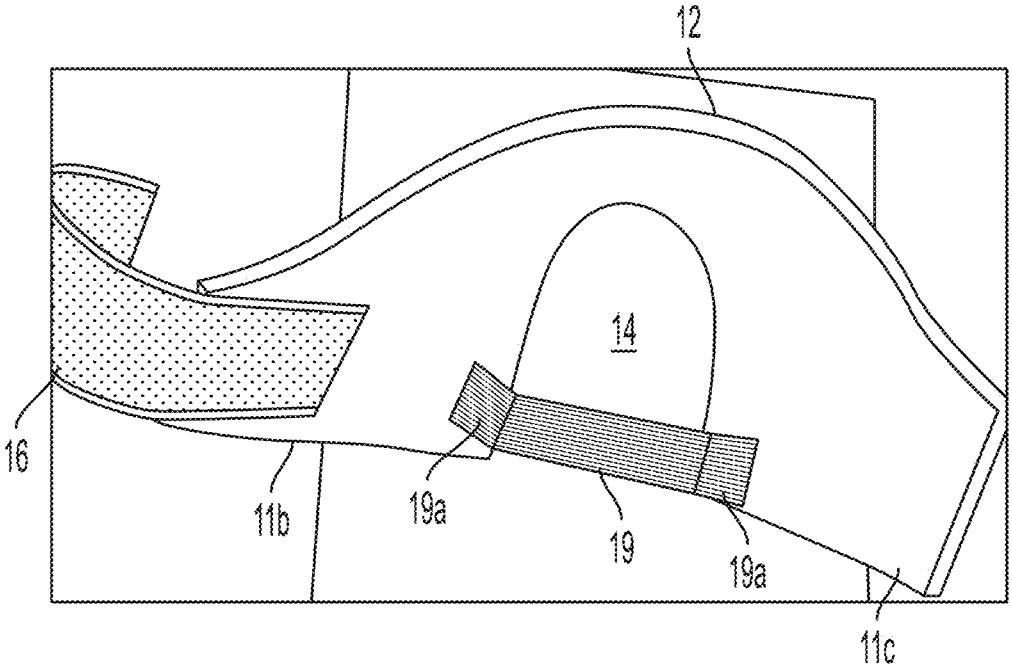
FIG. 2H shows a top view of the apparatus of FIG. 2A in an open arrangement.

The apparatus 10 may also be configured in "left" and "right" variations, which comprise the same elements, but with different orientations of the strap 16 or other adjustable closing mechanism. It is noted that for purposes of describing the two variations, the designations "left" and "right" are used in reference to the foot of the user where the apparatus is worn and the fastener 18 on the body 11 is disposed on the outer side of the user's foot. For example, FIGS. 2E and 2F show side-by-side views of a right apparatus 10 (FIG. 2E)

and a left apparatus 10 (FIG. 2F). In each variation, the fixed end 16*a* of the strap 16 is on the inner part of the user's foot or boot 50, and the strap 16 points towards the outer part of the user's foot or boot 50. However, other designations of side could be used, and the left and right variations of the apparatus 10 are not limited to being worn on any particular side of the user, as the user may wear two of the same variations of the apparatus 10, or may wear them in the reverse arrangement.

Figure 5A:
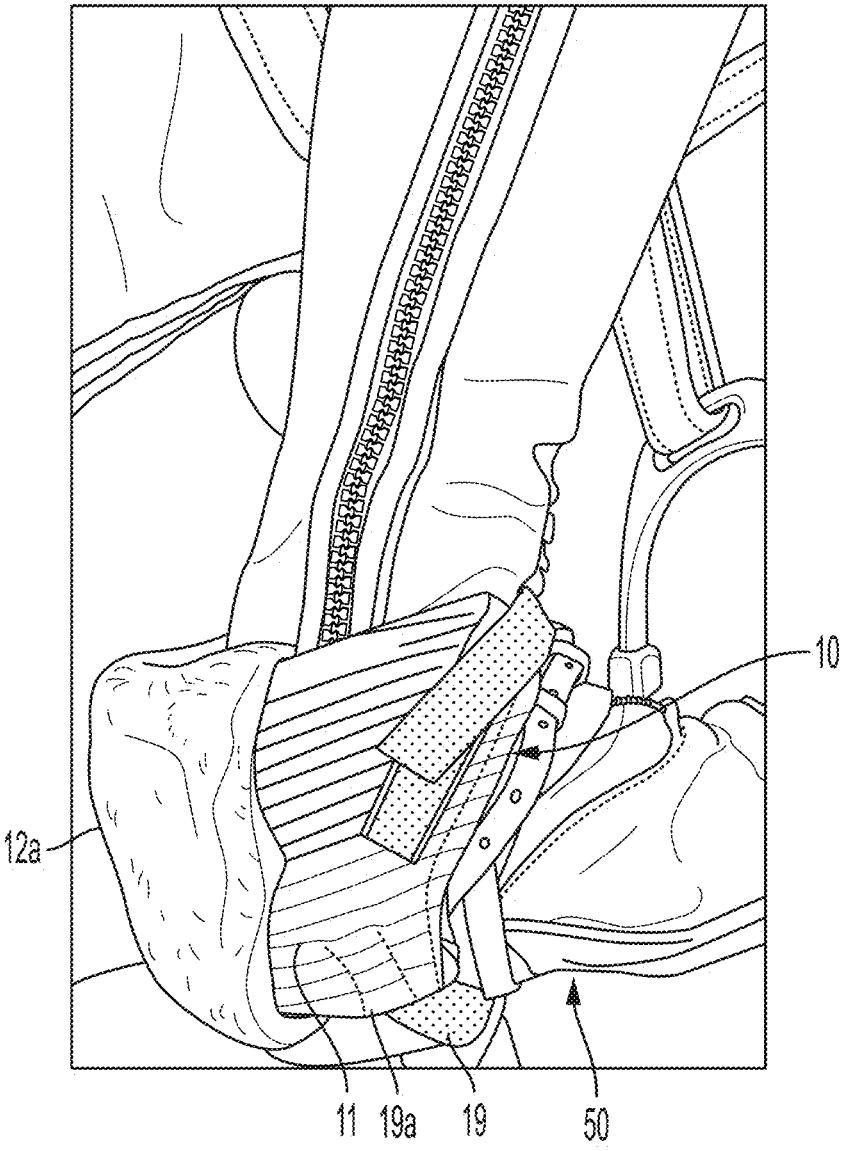
FIGS. 5A-5C show various views of an apparatus according to an embodiment of the present application further including a sheath.
Figure 5B:
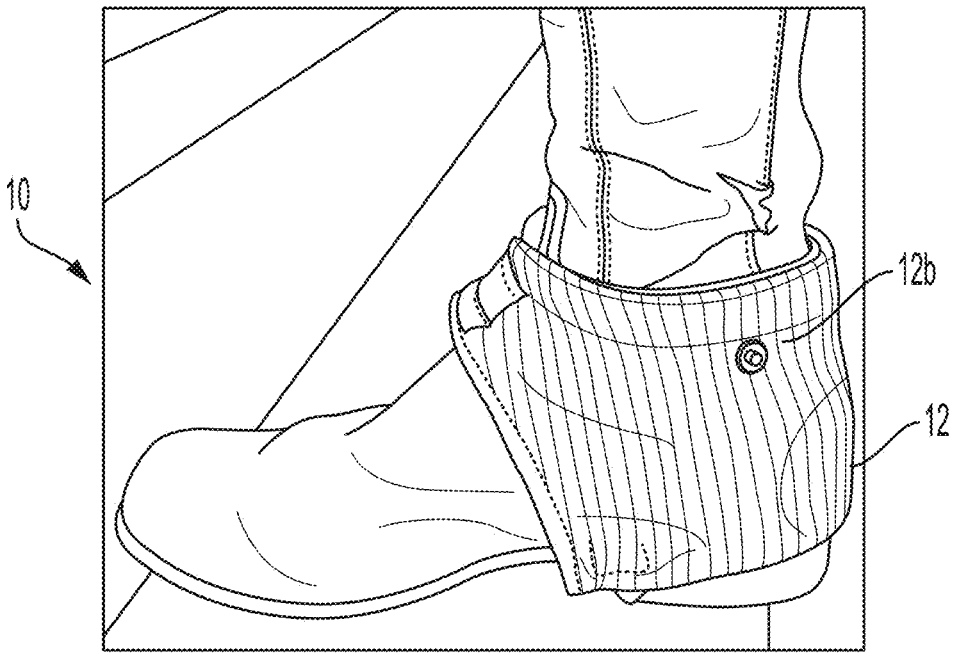
Figure 5C:
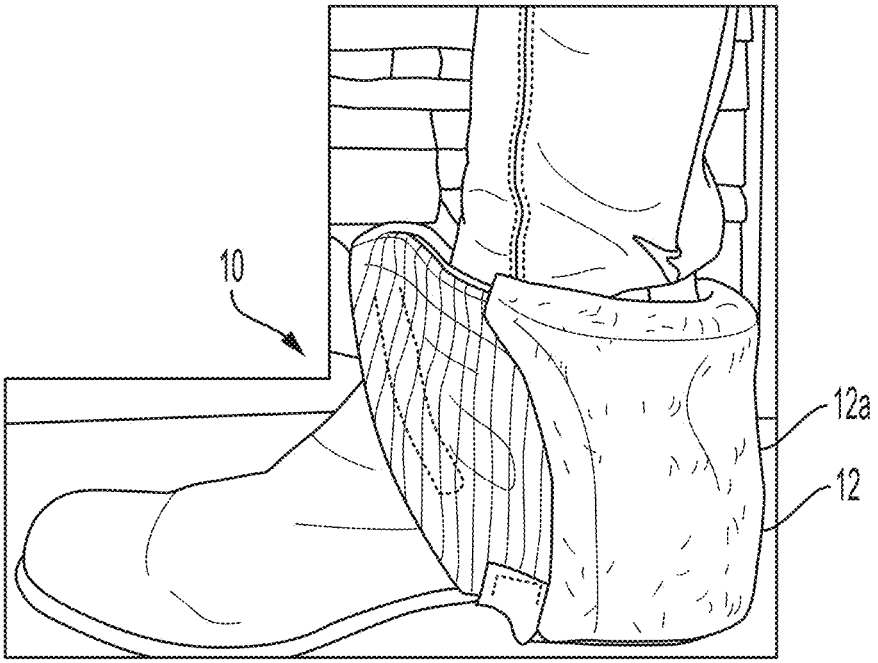
Figure 6A:
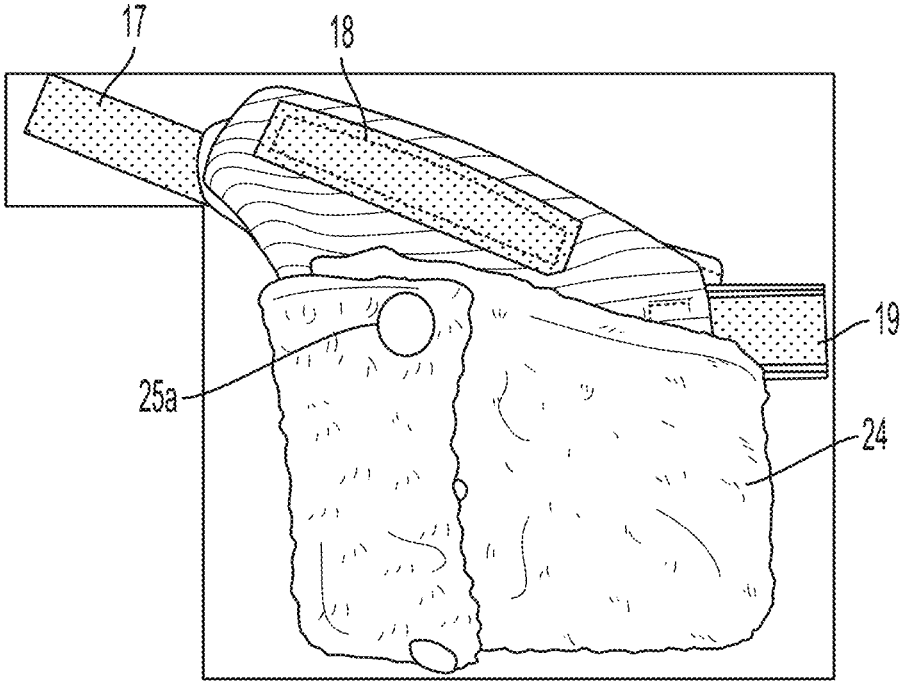
FIGS. 6A-6F show various views of an apparatus according to an embodiment of the present application further including a sheath.
Figure 6B:
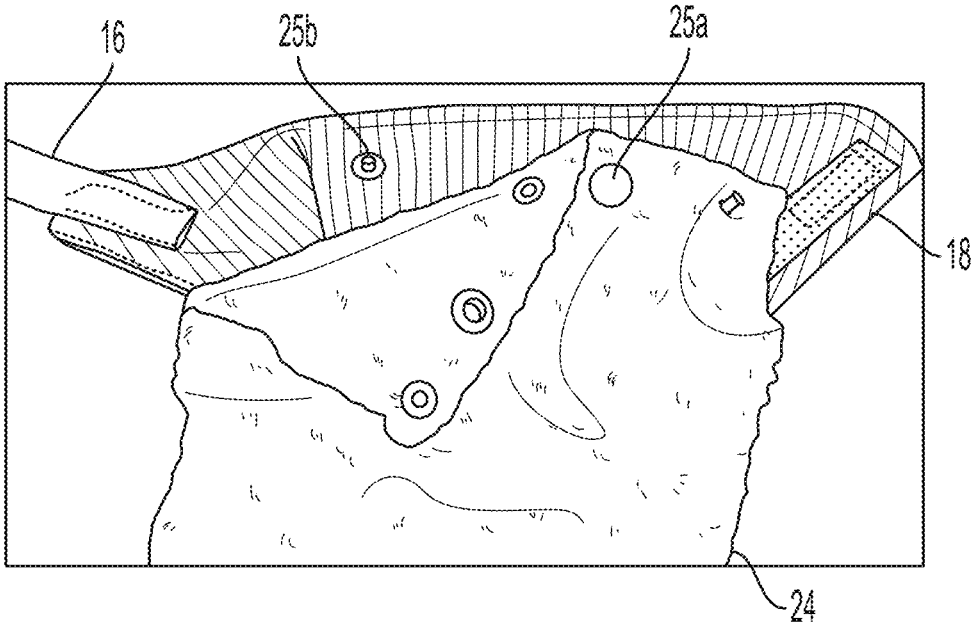
Figure 6C:
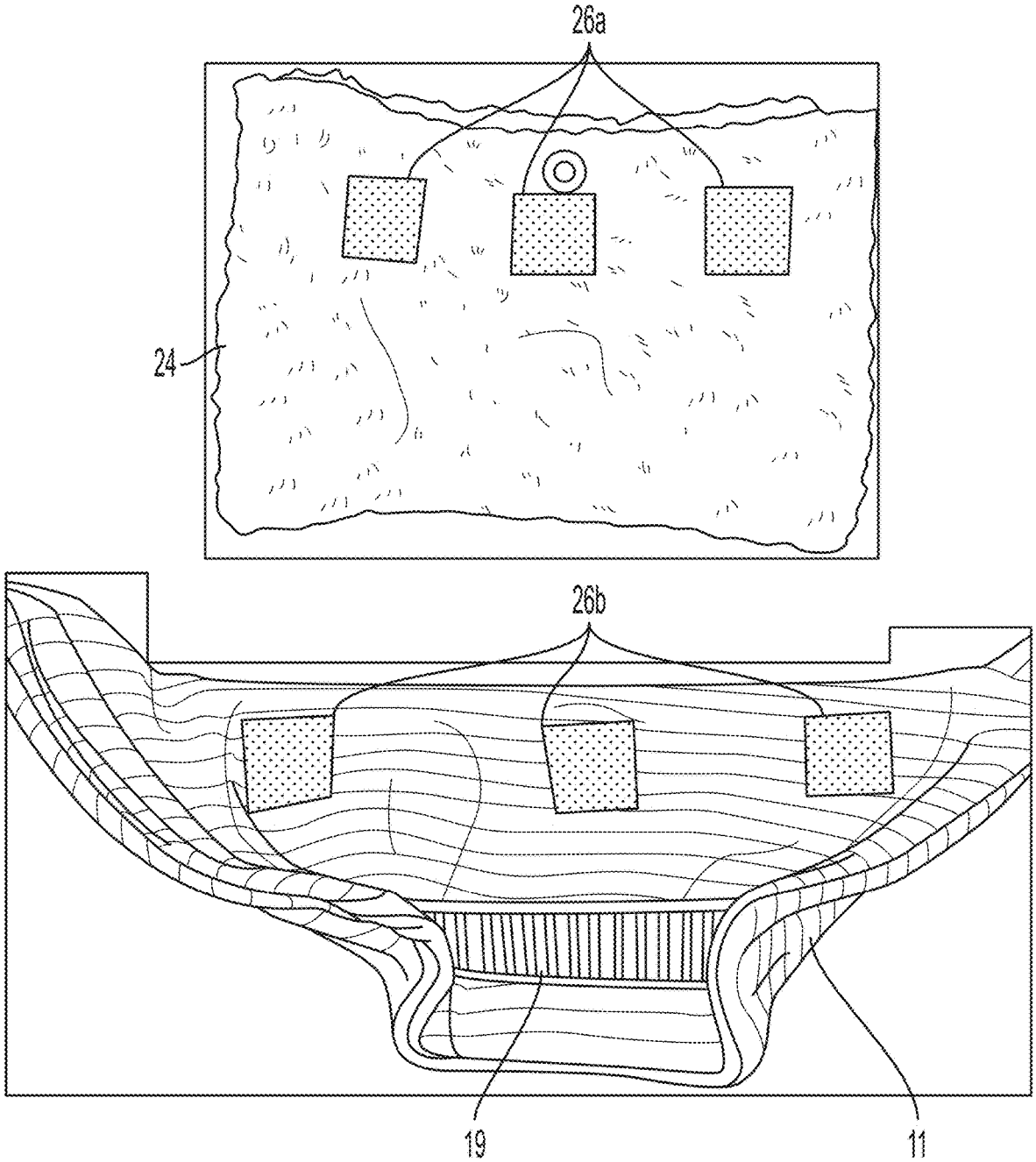
Figure 6D:
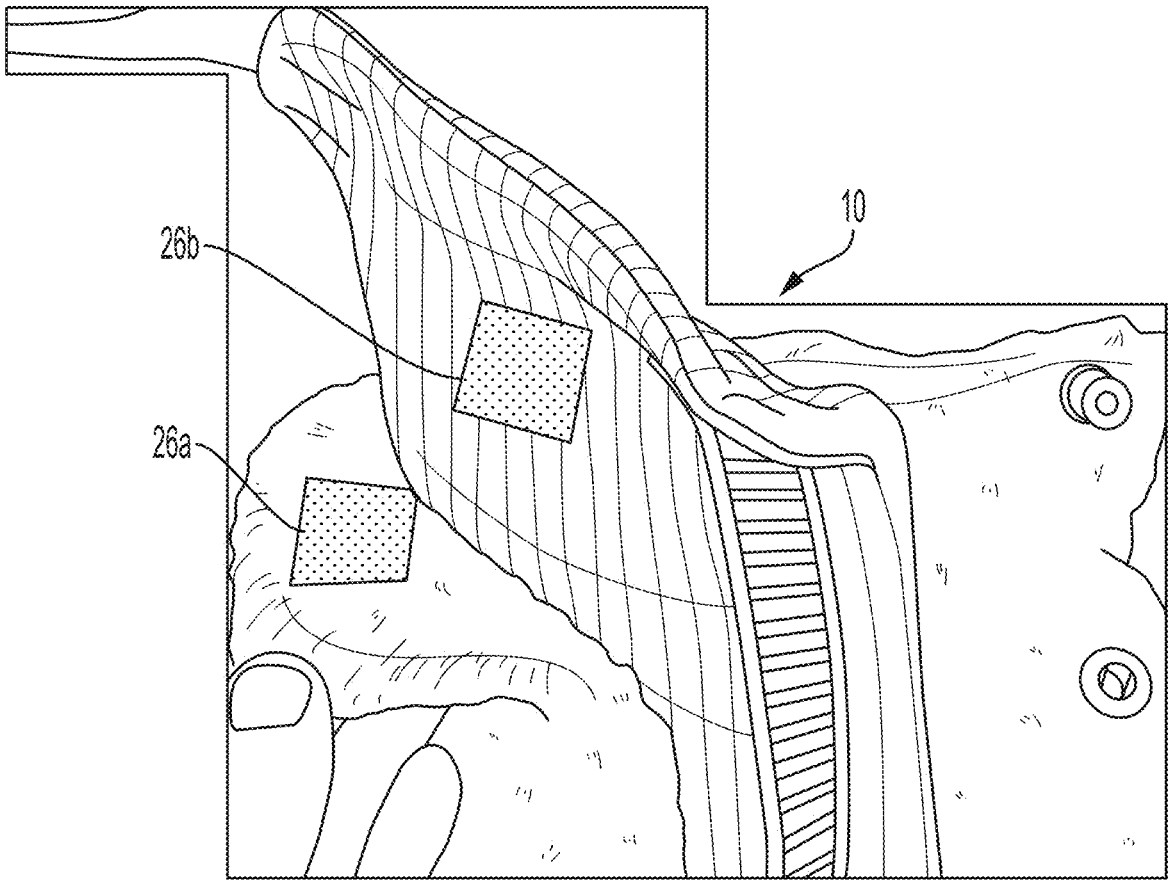
Figure 6E:
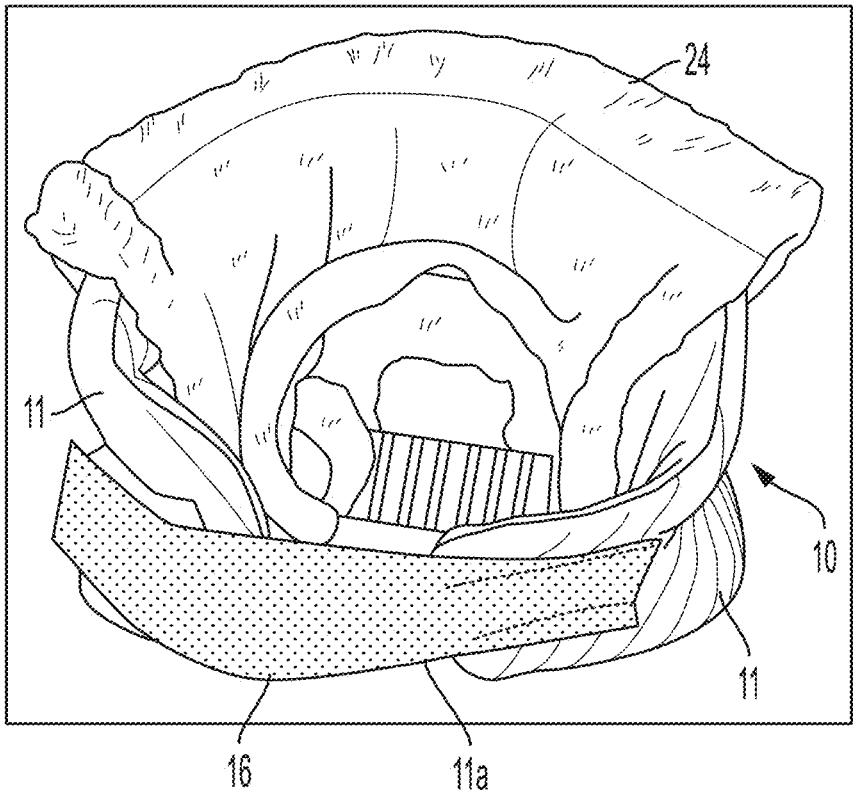
Figure 6F:
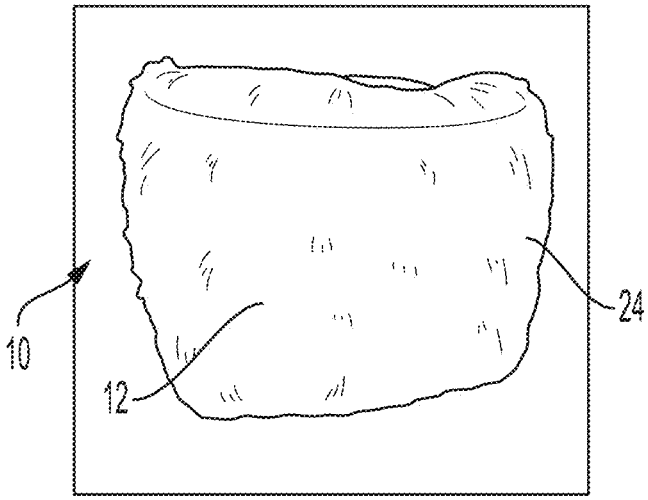

In an additional embodiment of the apparatus 10, shown for example in FIGS. 5A-5C, a removable shearling sleeve 12*a* is provided over the rear portion 12. The sleeve 12*a* provides aesthetic value and additional protection and comfort to the horse, as it may include a softer material on an exterior surface that can cover the rear portion 12 of the apparatus 10 that may contact the horse. The removable sleeve 12*a* may comprise connecting elements 12*b*, and can be removably connected to the apparatus 10 on the interior of the apparatus 10 and/or on the exterior of the apparatus 10, using any number of connection means, separately or in combination, including hook-and-loop fasteners, buttons, snaps, corresponding engaging magnetic elements, corresponding buckle and locking elements, strings or ropes configured to be tied, corresponding tabs and receiving elements, or any other suitable mechanism for securely connecting the sleeve 12*a* to the rear portion 12 of the apparatus 10, so as to cover the rear portion 12. The sleeve 12*a* may include a portion or portions that fold over the top opening 13 or bottom opening 14 to connect the sleeve 12*a* to the interior of the apparatus 10 via one or more connection means, such as buttons, snaps, hook-and-loop fasteners, or any other connection mechanism referenced herein. Alternatively, the sleeve 12*a* may be permanently attached to the apparatus 10 and not removable.

FIGS. 6A-6F show a variation of the embodiment in FIGS. 5A-5D, in which the apparatus 10 comprises a sleeve 24 covering substantially the entire body 11. The sleeve 24 may include a soft material on an exterior surface. The removable sleeve 24 may comprise connecting elements 25*a* configured to engage corresponding connecting elements 25*b* on an exterior surface of the apparatus 10. The removable sleeve 24 may also comprise connecting elements 26*a* configure to engage corresponding connecting elements 26*b* on an interior surface of the apparatus 10, and the sleeve 24 can be removably connected to the apparatus 10 on the interior of the apparatus 10 and/or on the exterior of the apparatus 10. In the embodiments illustrated in FIGS. 6A-6F, the exterior connecting elements 25*a*, 25*b* are snap connectors, and the interior connecting elements 26*a*, 26*b* are hook-and-loop fasteners. But the exterior and interior connecting elements can incorporate any number of connection means, separately or in combination, including hook-and-loop fasteners, buttons, snaps, corresponding engaging magnetic elements, corresponding buckle and locking elements, strings or ropes configured to be tied, corresponding tabs and receiving elements, or any other suitable mechanism for securely connecting the sleeve 24 to the body 11 of the apparatus 10.

The apparatus 10 can be made from any number of suitable materials that would provide for comfort for the horse and the rider and would prevent a spur from breaking through the apparatus 10. In various embodiments, the apparatus 10 is made from an elastic material that aids in allowing the apparatus to expand and contract around the boot and spur. But in other embodiments, the apparatus 10 can also be made of different, less elastic materials such as leather, or may be made of a cloth or other synthetic fabric material and may also include layers of such materials with an internal layer of a soft or padded material for additional protection and comfort.

The apparatus 10 can be formed of a single sheet of the material, or a multilayered sheet, which can be folded over with the two sides or ends connected by the lower strap 19. In versions of the apparatus 10 such as those shown in the Figures, the apparatus 10 is formed from an elongated strip of a single or multilayer material, which may comprise a substantially rectangular section that forms most of the body 11 of the apparatus 10, and may also comprise two wing sections 11*b*, 11*c* on the ends, which extend upward from the central rectangular section. The wing sections 11*b*, 11*c* may be where parts of the connection mechanism are located, such as the fixed end 16*a* of the strap 16 or the fastener 18. When the apparatus 10 is closed, the two wing sections 11*b*, 11*c* are brought together and are arranged over the boot 50 at the upper part of the user's foot, at or below the shin.

Figure 2I:
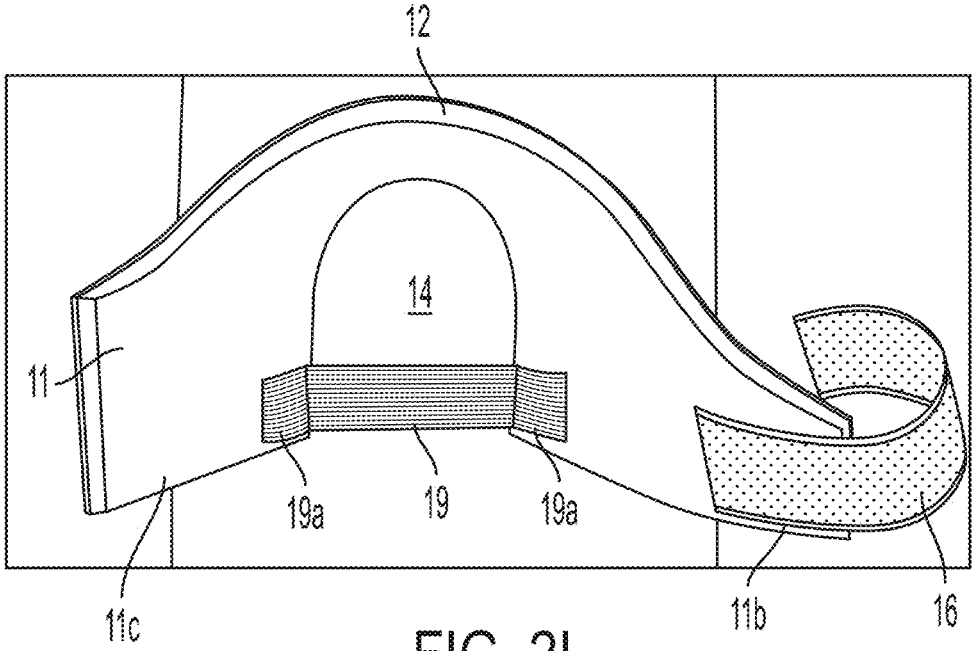
FIG. 2I shows a top view of the apparatus of FIG. 2B in an open arrangement.
Figure 3A:
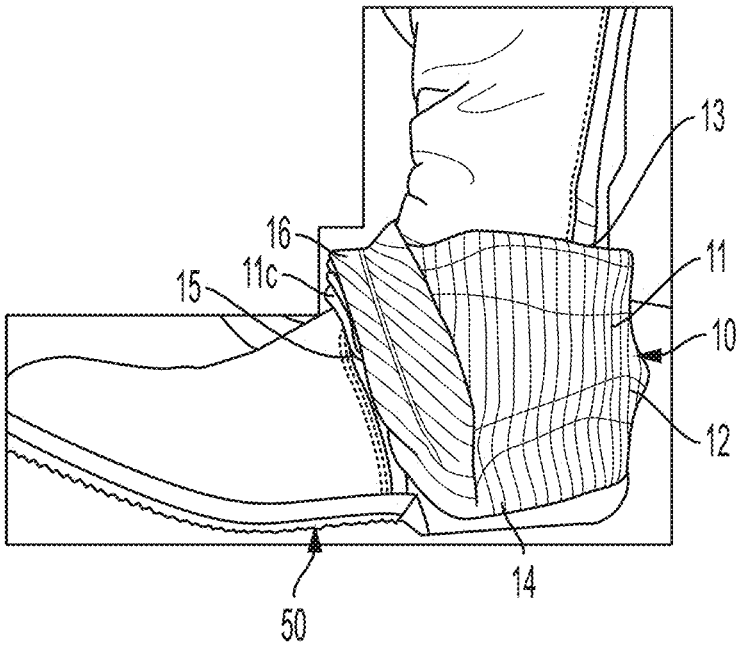
FIGS. 3A and 3B show first and second side views of an apparatus according to the present application.
Figure 3B:
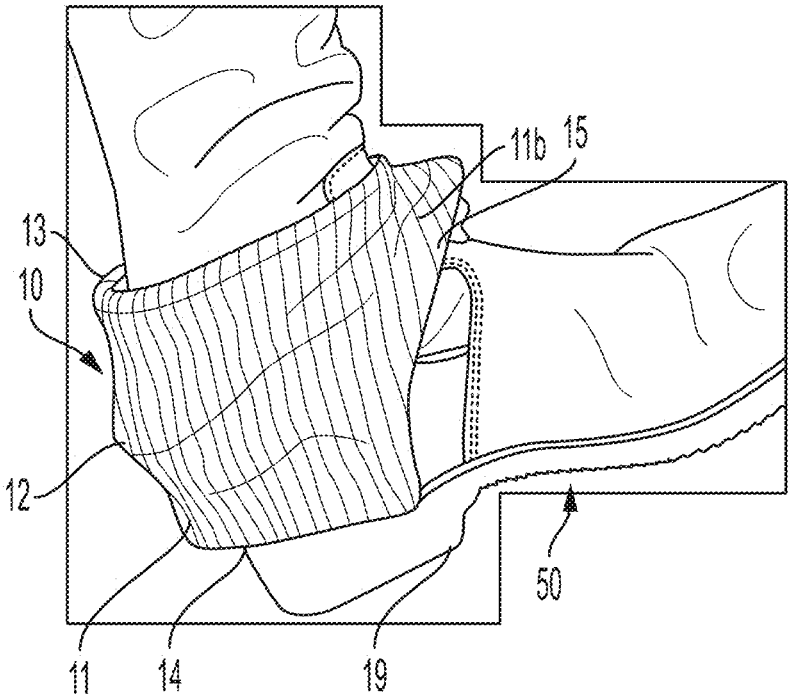
Figure 4:
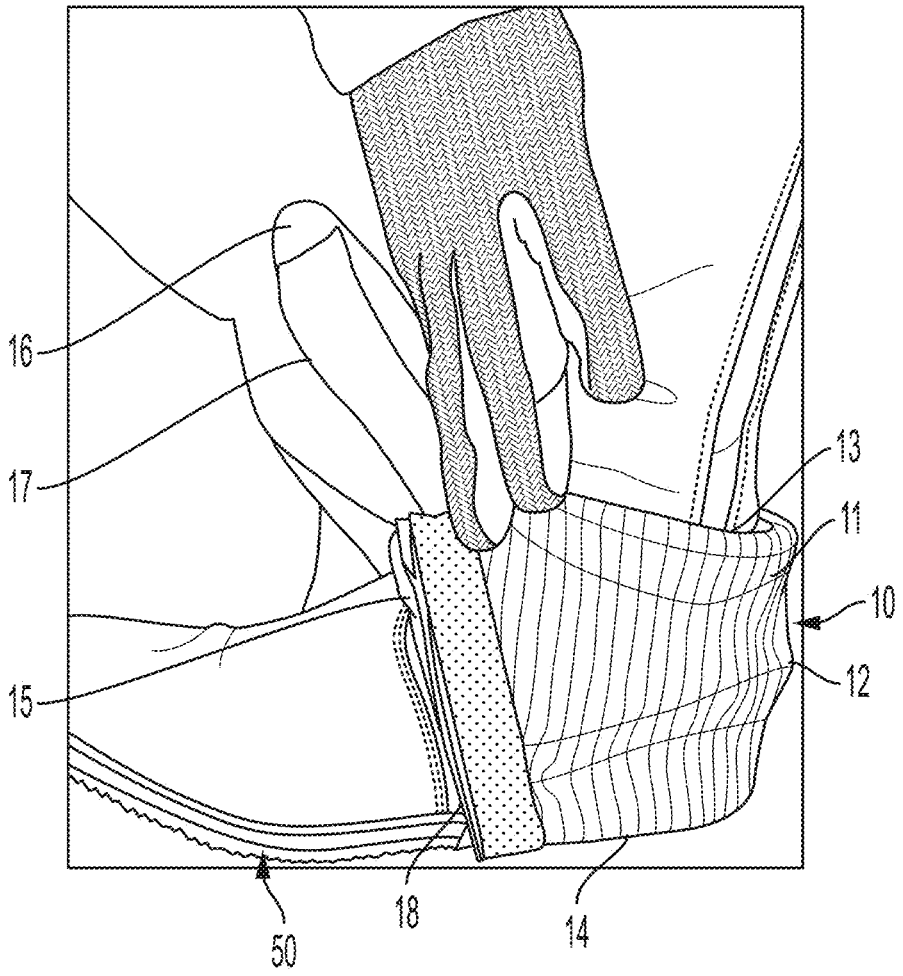
FIG. 4 shows a first side view of an apparatus in an open arrangement, according to the present application.

In the apparatus 10 illustrated in FIGS. 1-2I, the body 11 of the apparatus 10 is formed from an elastic, foam material which provides padding against horse, and which includes a core 21 having inner and outer fabric layers 22, 23. The body 11 may also be formed from a single layer of material. In several embodiments, at least the rear portion 12 of the body 11 comprises padding and in those illustrated in FIGS. 1-2I, the entire body 11 is made of a padded material. In the apparatus 10 illustrated in FIGS. 2-4, the body 11 of the apparatus 10 is formed of leather or a leather-like material, and may include a padding inside of the outer layers. The material for at least the rear portion 12, or the entire body 11, is also strong or thick enough to avoid puncture by a spur inside the apparatus 10.

In other embodiments, different parts of the apparatus 10 can be formed from different materials, such as providing for an elastic strap 16 made from a material that is more elastic than a material used for the body 11 of the apparatus 10. The openings 13, 14, 15 may also be configured with elastic bands to more easily allow their expansion when inserting the boot 50, and contraction around the boot 50 for a tighter fit.

While there have been shown and described and pointed out fundamental novel features of the invention as applied to preferred embodiments thereof, it will be understood that various omissions and substitutions and changes in the form and details of the devices and methods described may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice.

What is claimed:

1. An apparatus comprising:

a body section comprising a rear portion which is padded and configured to cover a lower rear part of a footwear item, the body section being configured to wrap around an ankle section of the footwear item;

an adjustable closure mechanism configured to close the apparatus and secure the apparatus around the ankle section of the footwear item;

an open top portion, an open bottom portion, and an open front portion, each of which is configured to receive a part of the footwear item therethrough; and a lower strap spanning across the open bottom portion, and which is configured to rest against a sole of the footwear item;

wherein the open front portion is defined by a gap that is formed between two ends of the body section and fully open when the adjustable closure mechanism is open, allowing the apparatus to be wrapped around the footwear item.

2. The apparatus of claim 1, wherein the adjustable closure mechanism comprises:

a strap having a first end fixed to a first part of the body section and having a second end comprising a fastening means; and a corresponding fastening means arranged on a second part of the body section separated from the first part of the body section by the gap, and configured to engage the fastening means on the strap.

3. The apparatus of claim 2, wherein the fastening means and corresponding fastening means comprise hook and loop fasteners.

4. The apparatus of claim 1, wherein the body section comprises:

a central section that is substantially rectangular and comprises the rear portion of the body section; and two wing sections, one wing section being disposed on each end of the central section, wherein each wing section extends upwardly from the central section and the two wing sections are configured to be brought together in closing the apparatus and substantially cover a front portion of the footwear item.

5. The apparatus of claim 4, wherein the adjustable closure mechanism comprises:

a strap having one end fixed to a first of the two wing sections and having a second end comprising a fastening means; and a corresponding fastening means arranged on a second of the two wing sections, and configured to engage the fastening means on the strap.

6. A system comprising:

a footwear item; and an apparatus arranged over and around an ankle section of the footwear item, comprising:

a body section comprising a rear portion which is padded and configured to cover a lower rear part of the footwear item, the body section being configured to wrap around the ankle section of the footwear item;

an adjustable closure mechanism configured to close the apparatus and secure the apparatus around the ankle section of the footwear item; and an open top portion, an open bottom portion, and an open front portion, each of which is configured to receive a part of the footwear item therethrough; and a lower strap spanning across the open bottom portion, and which is configured to rest against a sole of the footwear item;

wherein the open front portion is defined by a gap that is formed between two ends of the body section and fully open when the adjustable closure mechanism is open, allowing the apparatus to be wrapped around the footwear item.

7. The system of claim 6, wherein the footwear item is a horse riding boot, and the apparatus is configured to cover the lower rear part of the horse riding boot.

8. The system of claim 7, wherein the lower rear part of the horse riding boot comprises a spur arranged thereon, and wherein the apparatus is configured to cover the spur to prevent the spur from contacting a horse during riding.

9. The system of claim 8, wherein the body section comprises:

a central section that is substantially rectangular and comprises the rear portion of the body section; and two wing sections, one wing section being disposed on each end of the central section, wherein each wing section extends upwardly from the central section and the two wing sections are configured to be brought together in closing the apparatus and substantially cover a front portion of the footwear item.

10. The system of claim 9, wherein the adjustable closure mechanism comprises:

a strap having one end fixed to a first of the two wing sections and having a second end comprising a fastening means; and a corresponding fastening means arranged on a second of the two wing sections, and configured to engage the fastening means on the strap.

11. The system of claim 10, wherein the body section is formed of a material comprising:

a core material layer;

an inner material layer on one side of the core material layer; and an outer material layer on an opposing side of the core material layer.

12. A method of protecting a horse from a horse riding boot or a spur on a rider, the method comprising:

arranging an apparatus over and around an ankle section of the horse riding boot of the rider, the apparatus comprising:

a body section comprising a rear portion which is padded and configured to cover a lower rear part of the horse riding boot, the body section being configured to wrap around the ankle section of the horse riding boot;

an adjustable closure mechanism configured to close the apparatus and secure the apparatus around the ankle section of the horse riding boot; and an open top portion, an open bottom portion, and an open front portion, each of which is configured to receive a part of the horse riding boot therethrough; and a lower strap spanning across the open bottom portion, and which is configured to rest against a sole of the boot;

wherein the open front portion is defined by a gap that is formed between two ends of the body section and fully open when the adjustable closure mechanism is open, allowing the apparatus to be wrapped around the footwear item;

wherein the rear portion of the apparatus is configured to protect the horse from the lower rear part of the horse riding boot by preventing contact between the horse and the lower rear part of the horse riding boot.

13. The method of claim 12, wherein the lower rear part of the horse riding boot comprises a spur arranged thereon, and wherein the rear portion of the apparatus is configured to protect the horse from the spur by preventing contact between the horse and the spur.

* * * * *